US006848204B1

(12) United States Patent
Nowak

(10) Patent No.: US 6,848,204 B1
(45) Date of Patent: Feb. 1, 2005

(54) MULTIPURPOSE ADVERTISING DEVICE

(76) Inventor: Michael Nowak, 809 N. River Rd., Algonquin, IL (US) 60102

( * ) Notice: Subject to any disclaimer, the term of this patent is extended or adjusted under 35 U.S.C. 154(b) by 443 days.

(21) Appl. No.: 09/705,411

(22) Filed: Nov. 3, 2000

(51) Int. Cl.[7] ..... G09F 7/00

(52) U.S. Cl. ..... 40/209; 40/200; 40/643; 40/591

(58) Field of Search ..... 40/591, 200, 209, 40/611, 643, 644, 638

(56) References Cited

U.S. PATENT DOCUMENTS

| | | | | | |
|---|---|---|---|---|---|
| 2,213,666 | A | * | 9/1940 | Burke | 283/81 |
| 2,400,079 | A | * | 5/1946 | Ducey | 40/200 |
| 3,888,066 | A | | 6/1975 | Tabur | |
| 4,038,770 | A | | 8/1977 | Bott | |
| 4,110,502 | A | * | 8/1978 | Baer | 428/42.1 |
| 4,170,838 | A | | 10/1979 | Bott | |
| 4,172,331 | A | | 10/1979 | Becker | |
| 4,297,566 | A | | 10/1981 | Ahmann | |
| 4,302,896 | A | | 12/1981 | Bott | |
| 4,730,404 | A | | 3/1988 | Utsch | |
| 4,756,106 | A | | 7/1988 | Foster | |
| 4,819,355 | A | | 4/1989 | Solow | |
| 4,874,226 | A | | 10/1989 | McDonald | |
| 4,913,644 | A | | 4/1990 | Kauer | |
| 4,924,611 | A | | 5/1990 | Shaw | |
| 4,940,258 | A | * | 7/1990 | Cuba et al. | 283/81 |
| 4,955,153 | A | | 9/1990 | Albrecht et al. | |
| 4,970,809 | A | | 11/1990 | Bushbaum | |
| 5,149,571 | A | | 9/1992 | Croell | |
| 5,320,151 | A | | 6/1994 | Wumer | |
| 5,343,647 | A | * | 9/1994 | Bulka | 40/630 |
| 5,383,294 | A | | 1/1995 | Shen | |
| 5,442,873 | A | | 8/1995 | Vogler | |
| 5,487,568 | A | * | 1/1996 | Ipsen | 40/591 |
| 5,488,790 | A | * | 2/1996 | Blauer | 40/209 |
| 5,623,776 | A | * | 4/1997 | Lucier | 40/209 |
| 5,695,346 | A | | 12/1997 | Sekiguchi et al. | |
| 5,758,441 | A | | 6/1998 | Law | |
| 5,874,142 | A | * | 2/1999 | Hoffmann | 428/40.1 |
| 5,878,516 | A | * | 3/1999 | Amirian | 40/591 |
| 5,887,931 | A | * | 3/1999 | Bills et al. | 40/591 |
| D408,341 | S | | 4/1999 | Spencer | |
| 6,007,899 | A | * | 12/1999 | Yoshizawa et al. | 40/591 |
| 6,253,476 | B1 | * | 7/2001 | Powell | 40/591 |
| 6,262,807 | B1 | * | 7/2001 | Pleotis | 40/209 |
| 6,324,778 | B1 | * | 12/2001 | Gall | 40/200 |
| 6,550,166 | B1 | * | 4/2003 | Lyon | 40/209 |

* cited by examiner

*Primary Examiner*—James M. Hewitt
(74) *Attorney, Agent, or Firm*—Mathew R. P. Perrone, Jr.

(57) ABSTRACT

An advertising device capable of publicizing a business, especially a business related to a vehicle, by mounting the advertising device on a vehicle, preferably in the license plate area, is secured to a vehicle with or without framing a license plate.

8 Claims, 2 Drawing Sheets

MULTIPURPOSE ADVERTISING DEVICE

This invention relates to an advertising device, and more particularly to an advertising device capable of publicizing a business, especially a business related to a vehicle, by mounting the same on a vehicle.

BACKGROUND OF THE INVENTION

As is well known, a vehicle dealer likes to advertise. This is done by putting the dealership name on a vehicle in some fashion. The dealer hopes that new customers can be developed by seeing the name on the vehicle. Typical manners of so doing include putting a dealer name plaque on the vehicle itself or putting the dealership name on a frame mounted around a license plate.

With the dealer plaque on the vehicle itself, problems can arise. That dealer may not sell the vehicle. Whatever dealer does sell the vehicle cannot possibly appreciate having another dealer's name on the vehicle being sold. Such a plaque must be removed and replaced with one from the selling dealer. This procedure complicates the selling of a vehicle.

Two problems with the frame around a license plate are that the frame lacks durability and has a limited function, especially with regard to advertising. The limited function advertising is due to the small space available therefore.

The frame around a license plate, for example, can only be used with a license plate. This frame cannot be used without the plate. Thus, if a dealership desires to use the same, it must store the frames and attach them to the vehicle as the vehicle sells.

It is desired to minimize the problems associated with this storage of the frames. If a way can be found to store the frames efficiently and have a flexible use of the frames while at the same time providing the additional advertising or additional use of the frames, great advantages are obtained.

One item providing many functions for a vehicle dealer offers many advantages. However, it is difficult to provide this multi functioned item and keep the cost reasonable and the device simple, while granting these advantages. Any efforts in this area can be greatly appreciated by an auto dealer or a similar business.

SUMMARY OF THE INVENTION

Among the many objectives of this invention is the provision of an adaptable advertising sheet having the shape of a license plate.

A further objective of this invention is the provision an adaptable advertising plate capable of fitting with a variety of license plates.

Yet a further objective of this invention is the provision of an adaptable advertising sheet capable of being easily stored.

A still further objective of this invention is the provision of an adaptable advertising sheet capable of being efficiently used.

Another objective of this invention is the provision of an adaptable advertising sheet having an adjustable advertising area.

These and other objectives of the invention (which other objectives become clear by consideration of the specification, claims and drawings as a whole) are met by providing an advertising device capable of publicizing a business, especially a business related to a vehicle, by mounting the advertising device on a vehicle with or without framing a license plate.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

This invention relates to an advertising device in the form of a generally rectangular plate. Around the plate is a frame. Within the frame, thereby completing the plate, is a center section adapted to be punched out or removed from the frame as desired. The frame contains the necessary apertures for securing the device to a vehicle with or without a center portion.

The center portion is removably secured therein by cutting or other mechanisms. When the center portion is cut out or otherwise removed, the appropriate parts of the license plate can be seen through the frame. For example, some states have a requirement that the lower center portion of the plate be viewed in order for an add on tag to be adhesively secured to the plate, while avoiding the changing of the plate. Another plate requires that the upper right or left hand corner thereof be viewed in order to reveal the tags that belong there, depending on the style of tag or plate as used.

With this in mind, the center portion can be cut or adapted to be removed as required. Thus, if the upper corners are needed, the inner portion can be cut to expose that area. Because the sheet is flat, the entire sheet may be used to advertise the dealership. The center portion can contain advertising, which is usable for advertising until a license plate must be attached to the vehicle.

The sheet is applied to a vehicle thereby affixing a dealer's name to the vehicle in a simplified fashion. When it comes time to sell the vehicle and put license plates on it, it becomes a simple matter to punch out the center portion and secure the frame around the plate. Not only does the center portion of the device have advertising for the dealer, but the outside frame does too. Thus, with the device secured to the vehicle, the storage problem for license plate frames is avoided. Not only is advertising placed on a vehicle with this device, but this device is kept directly with the vehicle until the vehicle is sold and a license plate has to be more securely attached thereto than the device of this invention. The device may then be modified to support the plate.

In a preferred form the device may have one short tab on each of the four sides of device. Tabs may be added or reduced as desired depending on the structure desired. If a harder separation of the center from the frame is desired, the slits are shorter and the tabs are more numerous. However, the harder separation be desired in order to have a sturdier device. Such determinations can easily be determined, by considering this application as a whole.

Figure 1:
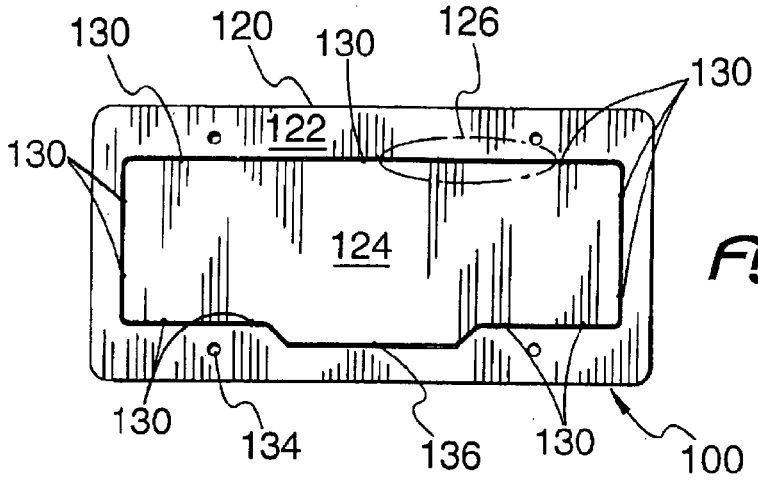
FIG. 1 depicts a front plan view of advertising device 100 of this invention showing a first embodiment 120.
Figure 2:
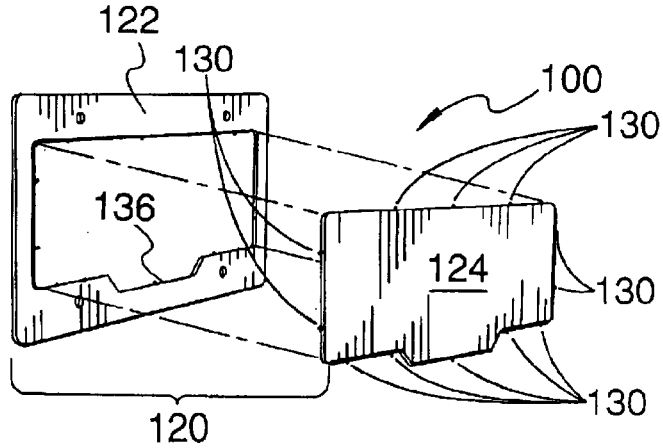
FIG. 2 depicts an exploded view of FIG. 1.

Referring now to FIG. 1 and FIG. 2, the first embodiment 120 of advertising device 100 has low tag plate frame 122 with low tag plate 124 removably secured therein. Low tag plate 124 is partially separated from low tag plate frame 122 by long slits 126. Separating one of long slits 126 from another of long slits 126 by short tabs 130. Breaking or cutting of short tabs 130, separates low tag plate 124 from frame 122 and leaves each frame apertures 134 free to receive a fastener (not shown) and to thereby secure frame 122 around a license plate (not shown). Low tag area 136 permits a license plate to receive the appropriate sticker (not shown) and be visible.

Figure 3:
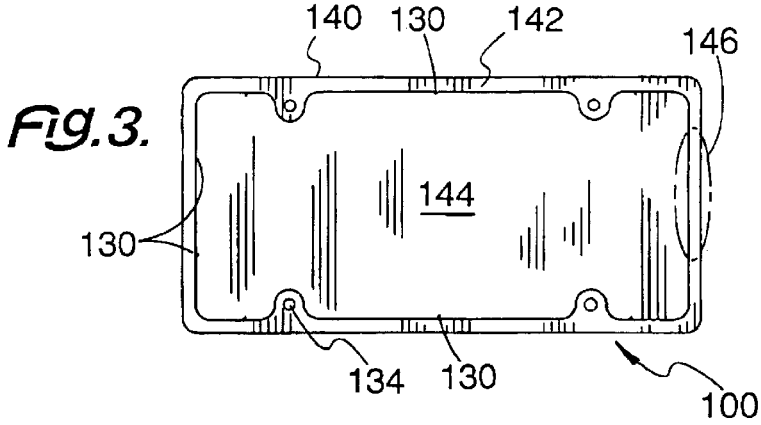
FIG. 3 depicts a front plan view of advertising device 100 of this invention showing a second embodiment 140.
Figure 4:
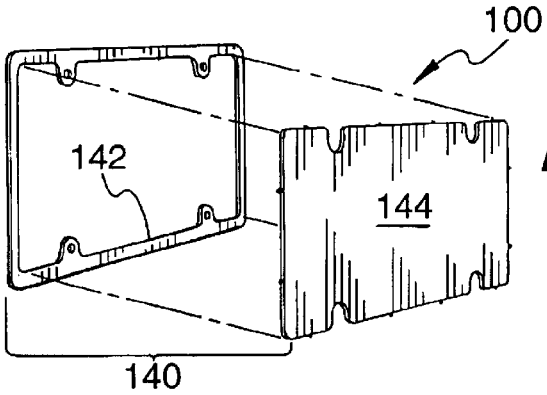
FIG. 4 depicts an exploded view of FIG. 3.

Referring now to FIG. 3 and FIG. 4, the second embodiment 140 of advertising device 100 has upper tag plate frame 142 with upper tag plate 144 removably secured therein. Upper tag plate 144 is partially separated from upper tag plate frame 142 by long separations 146. Separating one of long separations 146 from another of long separations 146 by short tabs 130. Breaking or cutting of short tabs 130, separates upper tag plate 144 from upper tag frame 142 and leaves frame apertures 134 free to secure frame 142 around a license plate for a vehicle. This upper tag frame 142 permits the appropriate sticker to be displayed in a corner of a license plate if required.

Figure 5:
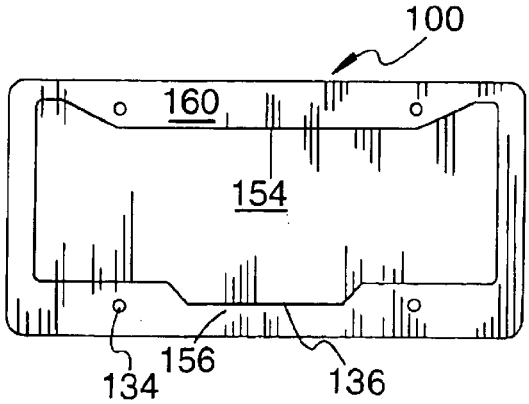
FIG. 5 depicts a front plan view of advertising device 100 of this invention showing still another and a third embodiment 150.

Referring now to FIG. 5, a third embodiment 150 depicts still another front plan view of advertising device 100. Third embodiment combines elements of FIG. 1 and FIG. 3. With dual frame 152 and dual purpose plate 154 having upper flap 160, upper corners of dual frame 152 provide for corner tags due to the shape of dual tag plate. With lower flap 156, low tag area 136 is also provided therein.

Upper tag plate 144, dual purpose plate 154, and lower tag plate 124 can be modified as desired depending on the type of license plate and where the yearly sticker for the license plate must be seen. Long separations 146 or long slits 126 are cut, molded, or otherwise formed in advertising device 100. Advertising device 100 is preferably formed from a flexible, durable, break-resistant plastic.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. An advertising device adapted for mounting on a vehicle comprising:

(a) a frame and a center section forming the advertising device;

(b) the advertising device being adapted for securing to a license plate area of a vehicle;

(c) the frame being securable to the vehicle;

(d) the frame and the center section being adapted to have advertising thereon;

(e) the frame being separable from the center section; and (f) the center section being of a size substantially the size of the license plate of the vehicle on which the advertising device is mounted; the center section, when removed from the frame, creates an aperture in the frame that permits display of the license plate therebeneath.

2. The advertising device of claim 1 wherein:

(a) the advertising device has at least one slit separating the center portion from the frame;

(b) the advertising device has at least one tab connecting the center portion to the frame;

(c) the at least one tab is capable of being severed in order to separate the center portion from the frame;

(d) the at least one slit and at least one tab provides a shape for the center portion relative to the frame; and (e) the frame including a fastening means to secure the frame to the vehicle.

3. The advertising device of claim 2 wherein:

(a) the frame separates from the center portion by severing all members of the class consisting of the at least one tab; and (b) the fastening means includes at least one aperture to secure the frame to the vehicle.

4. The advertising device of claim 3 having a generally rectangular shape.

5. In a vehicle having at least one advertisement thereon, the improvement comprising an advertising device with the at least one advertisement thereon adapted for mounting on the vehicle, the improvement further comprising:

(a) the advertising device having a multiplicity of uses;

(b) the advertising device including a frame and a center section;

(c) the advertising device being adapted for securing to a license plate area of a vehicle;

(d) the frame being securable to the vehicle;

(e) the frame and the center section being adapted to have advertising thereon;

(f) the frame being separable from the center section; and (g) the center section being of a size substantially the size of the license plate of the vehicle on which the advertising device is mounted; the center section, when removed from the frame, creates an aperture in the frame that permits display of the license plate therebeneath.

6. The vehicle of claim 5 wherein:

(a) the advertising device has at least one slit separating the center portion from the frame;

(b) the advertising device has at least one tab connecting the center portion to the frame;

(c) the at least one tab provides for severing the center portion from the frame;

(d) the at least one slit and the at least one tab provides a shape for the center portion relative to the frame; and (e) the frame including a fastening means to secure the frame to the vehicle.

7. The vehicle of claim 6 further comprising:

(a) the frame separating from the center portion by severing all members of the class consisting of the at least one tab; and (b) the fastening means includes at least one aperture to secure the frame to the vehicle.

8. The vehicle of claim 7 wherein the advertising device has a generally rectangular shape.

* * * * *